United States Patent [19]

Ploby et al.

[11] 4,011,934

[45] Mar. 15, 1977

[54] INK RIBBON AND PIVOTABLE HIGH SPEED PRINTING DEVICE MOVABLE FROM PRINTING TO NON-PRINTING POSITION

[75] Inventors: Bernt Inge Lennart Ploby, Jarfalla; Erik August Wilhelmsson, Stockholm, both of Sweden

[73] Assignee: Facit Aktiebolag, Atvidaberg, Sweden

[22] Filed: Oct. 30, 1975

[21] Appl. No.: 627,084

[30] Foreign Application Priority Data

Nov. 4, 1974 Sweden ..... 7413814

[52] U.S. Cl. ..... 197/154; 197/170

[51] Int. Cl.[2] ..... B41J 33/02

[58] Field of Search ..... 197/1 R, 151, 154, 157, 197/158, 170

[56] References Cited

UNITED STATES PATENTS

| | | | |
|---|---|---|---|
| 860,297 | 7/1907 | Hopkins | 197/154 |
| 2,672,092 | 3/1954 | Beattie | 197/158 X |
| 3,583,315 | 6/1971 | Herbert | 197/154 X |
| 3,643,777 | 2/1972 | Anderson et al. | 197/168 X |
| 3,724,633 | 4/1973 | Korb et al. | 197/151 |
| 3,762,530 | 10/1973 | Patel | 197/151 |
| 3,819,028 | 6/1974 | Drillick | 197/151 X |
| 3,834,512 | 9/1974 | Haugen | 197/151 X |
| 3,880,271 | 4/1975 | Hebron | 197/157 |
| 3,897,866 | 8/1975 | Mueller | 197/151 |
| 3,904,015 | 9/1975 | Boyden et al. | 197/151 |

FOREIGN PATENTS OR APPLICATIONS

| | | | |
|---|---|---|---|
| 912,319 | 4/1946 | France | 197/151 |
| 597,675 | 5/1934 | Germany | 197/157 |

*Primary Examiner*—Edgar S. Burr
*Assistant Examiner*—Paul T. Sewell
*Attorney, Agent, or Firm*—Alfred E. Miller

[57] ABSTRACT

An ink ribbon arrangement for a high speed printer, wherein the printer has a printing device which is movable in a given direction with respect to a recording medium. The ink ribbon comprises a pair of spools, and ribbon guides for guiding the ribbon between these spools in a path such that the ink ribbon extends past the printing device. The spools and the ribbon guides are mounted to form a single unit that is pivotally movable about an axis normal to the direction of relative movement between the printing device and recording medium. The unit may thus be moved to a printing position, wherein the ribbon extends obliquely with respect to the relative direction of movement between the printing device and the recording medium, and to a further position at which it extends substantially parallel to and below a line of text printed on the recording medium, thereby enabling reading of the line of text.

5 Claims, 4 Drawing Figures

INK RIBBON AND PIVOTABLE HIGH SPEED PRINTING DEVICE MOVABLE FROM PRINTING TO NON-PRINTING POSITION

This invention relates to an ink ribbon arrangement for a high speed printer or the like having two ink ribbon spools, wherein the ink ribbon passes between the spools via ribbon guides, in a path past the printing device of a high speed printer, and wherein the printing device is movable along a recording medium.

BACKGROUND OF THE INVENTION

In high speed printers with ink ribbons arrangements are known for raising and lowering the ribbon by means of a complex arrangement consisting of a raise and a lower magnet, a friction clutch, a cam disc, a cam follower, and a number of levers, in order to enable the reading of the last printed text.

In another known arrangement (see U.S. Pat. No. 3,822,005), the ink ribbon follows a path adjacent the paper only at the actual printing point. In this arrangement, the spools must follow the movement of the printing device along the recording medium. This results in the disadvantage that the printer must be relatively slow due to the inertia of the large movable mass.

The object of the invention is to provide a simpler, more reliable, and improved device for vertical adjustment of the ribbon. At the same time, the device of the invention is constructed so that printing lines extend obliquely across the ribbon, resulting in the important advantage that the ribbon is utilized more effectively and therefore needs changing more seldom.

According to the invention, these objects are achieved by arranging the spools and the ribbon guides in one unit, this unit being pivotable around a shaft extending perpendicularly to the path of movement of the printing device.

In order that the invention will be more clearly understood, it will now be disclosed in greater detail with reference to the accompanying drawings, in which.

DESCRIPTION OF THE PREFERRED EMBODIMENT OF THE INVENTION

Figure 1:
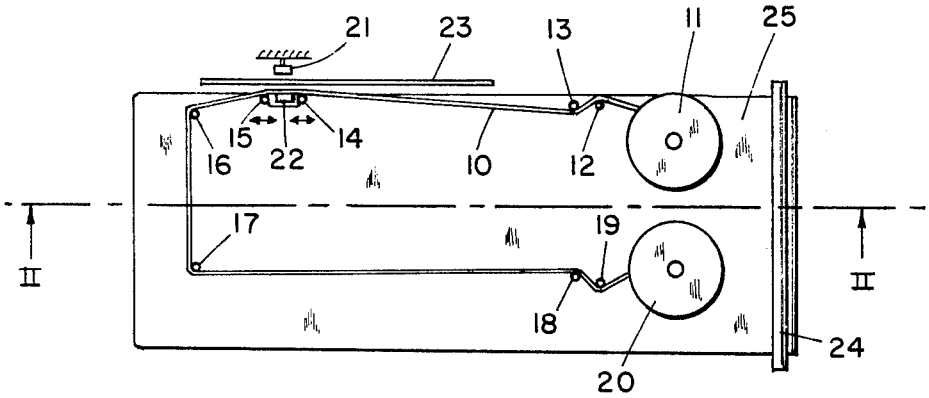
FIG. 1 is a diagrammatic top view of an ink ribbon arrangement in accordance with the invention.

Referring now to FIG. 1, an ink ribbon 10 is fed from a spool 11 via a number of ribbon guides 12–19 to another spool 20. When there is no ribbon left on the spool 11, the direction of feed is reversed in a known manner (not shown) so that the ribbon is fed from the spool 20 to the spool 11.

A conventional printing device, for example consisting of a helix wheel 21 and a hammer device 22 coacting with the helix wheel, forms a rigidly interconnected unit, which during printing moves horizontally along a paper 23 or another recording device. The printing device 21, 22 may, for instance, be of the kind described in U.S. Pat. No. 3,926,293 issued on Dec. 16, 1975. The ribbon guides 14, 15 situated on each side of the hammer device 22 are moved in a horizontal direction with the printing device so that the ink ribbon is always correctly placed in relation to the hammer device 22 and the helix wheel 21. This movement of the devices 14, 15 is indicated by two-headed arrows below these devices.

Figure 2:
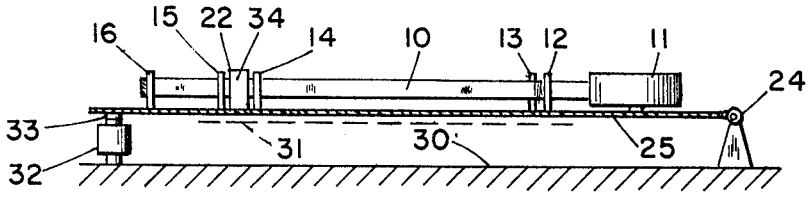
FIG. 2 is a diagrammatic cross-sectional view of the ink ribbon arrangement of FIG. 1, taken along the lines II-II, with the ink ribbon in a position to enable reading of a line of text.
Figure 3:
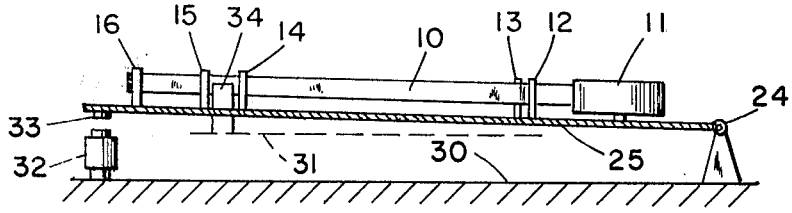
FIG. 3 is a diagrammatic cross-sectional view of the ink ribbon arrangement according to FIG. 2, with the ink ribbon in printing position.

As is best seen in FIGS. 2 and 3, the typewriter spools 11, 20 as well as the ribbon guides 12–19 are arranged on a frame 25 pivoted around a shaft 24. The frame can be formed in many different ways, and the only important consideration is that it connects the devices 11–20 to each other so that all of these as a unit may be pivoted in common around the shaft 24. The printing device 21, 22, however, is not fastened to the frame 25 and hence is not moved in a vertical direction with the frame 25, i.e., it is held stationary in relation to a support 30 when the frame 25 is pivoted. However, as already mentioned, the printing device is movable in a horizontal direction. In FIGS. 2 and 3, this horizontal direction is indicated by a dashed line 31, which is parallel to the support 30, and along which the printing device is adapted to move. The turning of the frame 25 around the shaft 24 is controlled by an electromagnet 32, which when energized attracts an armature 33 and thereby turns the frame to a horizontal position (see FIG. 2). When the magnet 32 is not energized, the frame is kept in its raised position, as shown in FIG. 3, by means of a conventional spring device or the like (not shown).

The arrangement described operated in the following manner:

During the printing, the electromagnet 32 is not energized, and thus the ink ribbon unit assumes the position shown in FIG. 3. During printing, the printing device 21, 22 as well as the ribbon guides 14, 15 are moved from the left to the right as indicated by the arrows in FIG. 1. The inclination of the frame 25 when the electromagnet is not energized must not be so great that the ink ribbon, during the whole horizontal movement of the printing device, is displaced from its position between the hammer — indicated at 34 — of the hammer device and the paper 23. In other words, when the electromagnet 32 is not energized, the ink ribbon 10 must extend obliquely to the direction of movement of the printing device such that it extends between the hammer 34 and the paper 23 at any position of the hammer from the left margin to the right margin of the line of text to be printed. As soon as printing ceases, the magnet 32 is energized and attracts the armature 33 so that the frame and thereby the ink ribbon unit assume a horizontal position, as is shown in FIG. 2. The ink ribbon 10 is thereby moved downwards so that the last print becomes visible. For practical reasons the magnet is preferably not energized until after a short delay so that a very short stop in the printing will not influence the ink ribbon unit.

In the arrangement illustrated in FIGS. 1, 2, and 3, it is apparent that the spools 11, and 20, and the guides 12, 13, 16, 17, 18, and 19 are mounted fixedly with respect to one another on the frame 25, while the guides 14, and 15, although mounted on the frame 25 for rotation about the axis 24, must also move horizontally with the printing device 21, 22. For this purpose, the guides 14, 15 may be slideably mounted on the frame 25, with suitable intercoupling being provided between these guides and the printing device so that horizontal movement of the printing device effects the sliding of the guides 14, 15 along the frame 25 as the printing proceeds from the left to the right margins. For example, the guides 14, 15 may be mounted on a common mount (not shown), which is mounted to slide in a suitable slide groove (not shown) in the guide frame 25. In this case, suitable projections (not shown) on the printing device may loosely engage the guides 14, 15 so that the guides 14, 15 move along the frame 25 as the printing device moves in the horizontal direction. It will be apparent, of course, that any conventional arrangement may alternatively be employed enabling such movement of the guides 14, 15.

Figure 4:
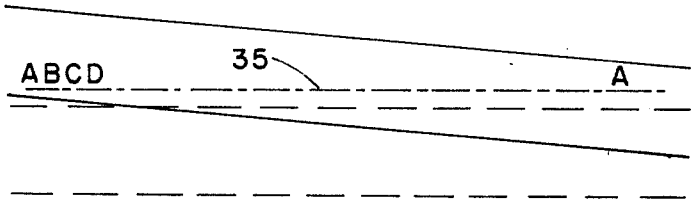
FIG. 4 is a simplified diagrammatic illustration of the two positions of the ink ribbon, illustrating how the printing and viewing of the line of text may be effected.

FIG. 4 shows diagrammatically the position of the ink ribbon in upper (continuous lines) and lower (dashed lines) positions. Printing is assumed to be made along a diagrammatically marked dotted line 35. As appears in this figure, the upper edge of the ink ribbon is situated below the line 35, when the ribbon assumes a horizontal position, i.e., when printing is not made and consequently the print can be read without difficulty. In printing position, however, the ribbon assumes such a position that the line 35 furthest to the left will be situated immediately above the lower edge of the ribbon and furthest to the right below and at some distance from the upper edge of the ribbon. This latter distance must be at least as large as the height of a printed character but should not be substantially larger. Thus, due to the inclination of the ribbon, printing is effected obliquely or transversely across the ribbon. As a result, the ribbon is used more effectively than if printing were effected exactly in the lengthwise direction of the ribbon. After the feed direction of the ribbon has been reversed, when the ribbon is fed in the opposite direction, it is not probable that the printing will be exactly along an already used diagonal of the ribbon. As a matter of fact, a great number of reversals of the ribbon feed direction are required before the probability becomes especially great that a part of the ribbon used before will be used again. The invention thus provides the advantage that the ink ribbons may be employed for a longer period of time without replacement, than in conventional ink ribbon arrangements.

What is claimed is:

1. In an ink ribbon arrangement for a high speed printer having a printing device movable in a given direction with respect to a recording medium, a pair of spools, an ink ribbon extending between said spools, and ribbon guides positioned to direct said ink ribbon between said spools in a path which extends past said printing device; the improvement comprising a first means mounting said spools and said ribbon guides to form a single frame unit, and a second means pivoting said frame unit for rotation about an axis perpendicular to said given direction, said second means including means including an electromagnet mounted and arranged to move said frame unit to a printing position by rotation about said axis, with the lengthwise direction of said ribbon extending inclined to said given direction whereby said printing device passes substantially diagonally over said ink ribbon during printing, and in a non-printing position by rotation about said axis whereby the portion of said ink ribbon extending along the recording path of said printing device assumes a position parallel to said given direction.

2. The ink ribbon arrangement of claim 1 wherein said means for mounting comprises means for mounting said spools adjacent each other at one side of said recording medium.

3. The ink ribbon arrangement of claim 2 wherein said means for mounting comprises means for mounting said ribbon guides and spools on the same side of said axis, whereby the path of the ink ribbon is also on said same side of said axis.

4. The ink ribbon arrangement of claim 1 wherein said means pivoting said unit comprises a shaft extending perpendicularly to said given direction, said frame being pivotally mounted to said shaft.

5. The ink ribbon arrangement of claim 4 wherein said guide means comprises at least one guide means slideably mounted to said frame for movement with said printing device during printing of a line of text between left and right margins.

* * * * *